United States Patent [19]

Drakulic

[11] 4,067,151

[45] Jan. 10, 1978

[54] CURTAIN ROD SUPPORT

[76] Inventor: Melvin Drakulic, Box 482, Trafford, Pa. 15085

[21] Appl. No.: 709,232

[22] Filed: July 27, 1976

[51] Int. Cl.[2] ..... E04F 19/00

[52] U.S. Cl. ..... 52/27; 248/262

[58] Field of Search ..... 52/27, 36, 713, 506, 52/509; 248/221 R, 216, 226 R, 262, 220.5, 261

[56] References Cited

U.S. PATENT DOCUMENTS

| | | | |
|---|---|---|---|
| 1,935,553 | 11/1933 | Gerard | 248/262 |
| 2,682,385 | 6/1954 | Schluter | 248/262 |
| 3,778,942 | 12/1973 | Bondi | 52/509 X |

*Primary Examiner*—Price C. Faw, Jr.

*Assistant Examiner*—Carl D. Friedman

*Attorney, Agent, or Firm*—Thomas H. Murray

[57] ABSTRACT

A rod used for supporting window dressings and the like on a wall surface is supported on the wall by a base plate. This plate is secured to the wall studding and embedded within the wall to support an internally-threaded tubular member which projects through the plaster, paneling, etc. for attachment at the outer face thereof to a carrier plate. The carrier plate has a trapezoidal shape with a plurality of holes therein in a spaced-apart arrangement designed for an attachment by self-threading screws to holder brackets used to support the curtain rod. The carrier plate can be rotated to a desired orientation at the end of the tubular member for supporting different types of curtain rods.

5 Claims, 4 Drawing Figures

CURTAIN ROD SUPPORT

BACKGROUND OF THE INVENTION

This invention relates to a support apparatus for carrying a window dressing and the like while attached to rod means including adapter members normally used to carry the rod means while spaced outwardly from the finished face surface of a wall. More particularly, the present invention relates to such a support apparatus wherein wall studding or the like is used for attachment of a base plate thereto while carrying a connector that extends through the wall for receiving at the exposed end thereof by a threaded fastener, a carrier plate used to support the adapter members for a curtain rod or the like.

As is well known in the art, various forms of rodlike supports have been devised for carrying drapes, curtains and similar dry goods for decorative purposes upon walls, particularly at the window openings therein. Because numerous different forms of support rods have been devised, each usually adapted for a particular style or type of covering, it was necessary in the past to attach the support rods in various different ways to the wall surface. This frequently required drilling holes in the wall to receive special inserts that, in turn, receive the threads of a screw passed through a bracket at the face of the wall. Many times, the wallboard, paneling and the like used to form the wall do not have sufficient strength to provide a support surface for the particular bracket. When changing from one style of rod support to another, for example, when redecorating or a change in tenants in a rental housing, the wall surface is usually damaged which is unsightly and requires repair work. These are but a very few circumstances wherein it is highly desirable to provide an improved apparatus for carrying a rod member for curtains, draperies and the like upon a wall surface.

SUMMARY OF THE INVENTION

It is an object of the present invention to provide an improved support apparatus for carrying a rod device at its opposite ends while spaced outwardly from the finished face surface of a wall in a manner which will avoid the need for establishing a threaded connection with the wall surface for supporting the rod member.

It is another object of the present invention to provide an improved support apparatus for carrying a rod member used for securing curtains, draperies and the like along a wall surface which apparatus is designed to embody a minimal of parts capable of construction in an economical manner while readily adapted for use by untrained personnel in a rapid and efficient manner.

It is still another object of the present invention to provide an improved support apparatus adapted for carrying any one of a number of various types and forms of rod members used for carrying curtains, draperies and the like along a wall surface.

In accordance with the present invention, there is provided a support apparatus for carrying a window dressing and the like while attached to rod means including adapter members normally used to carry the rod means while spaced outwardly from the finished face surface of a wall, the apparatus including a base plate adapted for embedded support within the wall at a spaced location from the finished face surface thereof, connector means carried by the base plate to project outwardly through the wall at the finished face surface thereof, a carrier plate including means for releasably securing an adapter member of the rod means thereto and thereby supporting the rod means, and fastening means to secure the carrier plate to the connector means for transferring the load carried by the rod means onto the wall by the base plate.

The preferred form of the present invention further provides that the aforesaid connector means include an internally-threaded tubular member to project outwardly from the finished face surface of the wall and that the fastening means include a screw having threads for mating engagement with the threads of the tubular member. Preferably, the base plate includes a rectangular plate having a plurality of spaced-apart openings arranged to receive fastening members for attachment thereof to studding within the wall. The carrier plate preferably has a trapezoidal shape with a plurality of spaced-apart openings arranged in a predetermined manner for receiving self-tapping type fasteners.

These features and advantages of the present invention as well as others will be readily apparent when the following description is read in light of the accompanying drawings, in which.

Figure 1:
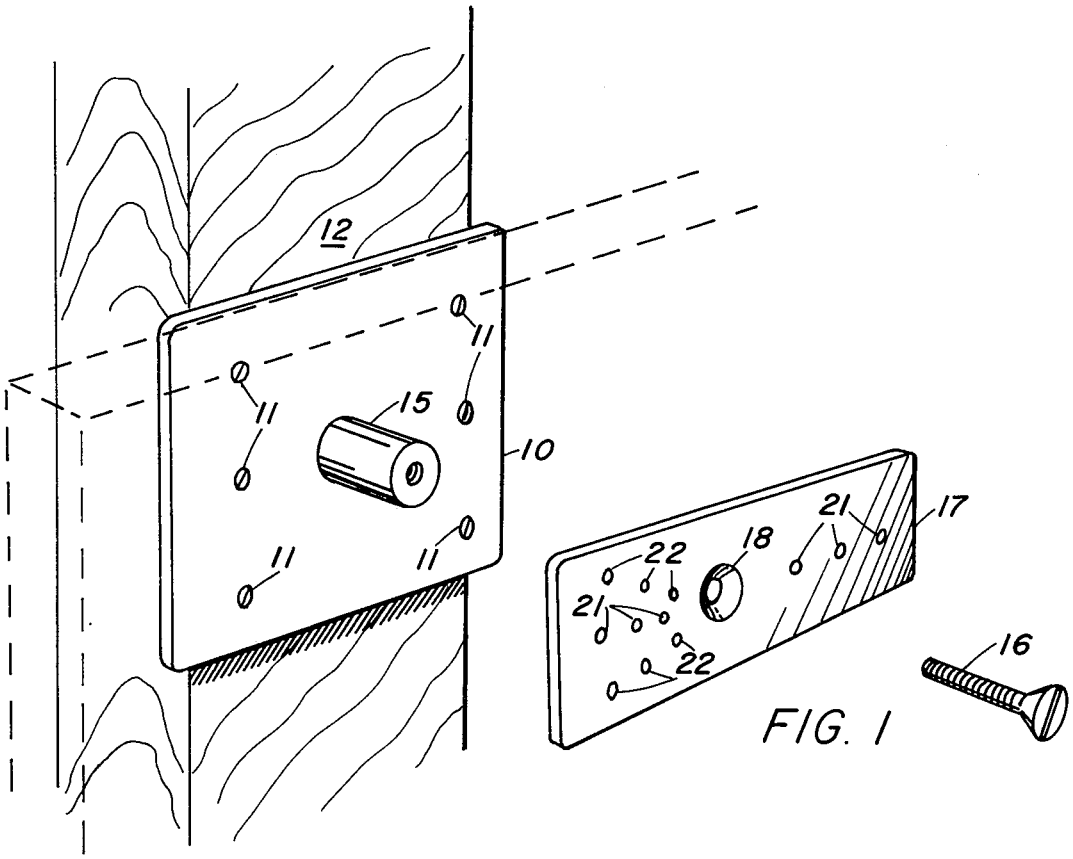
FIG. 1 is an exploded view illustrating the combination of parts to provide a support apparatus according to the present invention.
Figure 2:
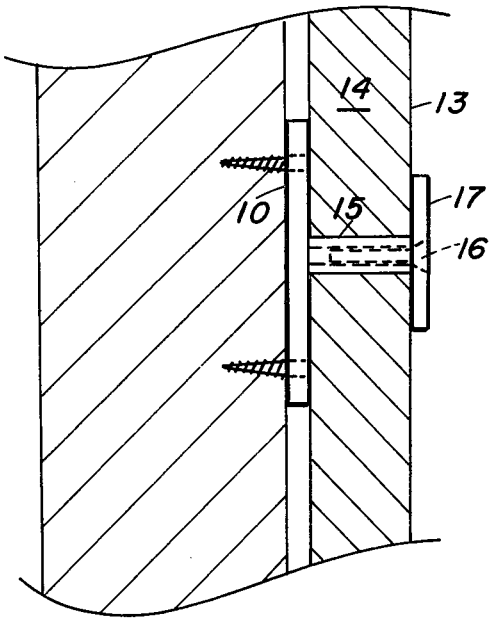
FIG. 2 is an elevational view, in section, of the parts shown in FIG. 1.

The support apparatus of the present invention includes a rectangularly-shaped base plate 10 which preferably has a length and width selected for attachment of the base plate by way of holes 11 onto the edge face surface 12 of a wall stud or the like used to form the support structure for a wall. The base plate 10 is selected so that it has a thickness that is relatively small to avoid a corresponding protuberance or disruption to the face surface 13 of a wall. The actual wall is made from a suitable material such as plaster, wallboard, wood paneling and the like. A connector member 15 is welded or otherwise secured at a central location to the exposed face surface of the base plate. Connector 15 has a length to extend through the thickness of the wall 14 so that its outwardly-projecting end forms either a flush relation with the surface 13 or projects outwardly therefrom for a relatively short distance. The connector means 15 preferably takes the form of an internally-threaded tubular member having internal threads adapted to form a mating engagement with the threads on a machine screw 16.

The machine screw 16 is used to support a carrier plate 17 by way of a centrally-arranged opening 18. The carrier plate preferably has a trapezoidal shape for defining on its face surface a plurality of openings lying at spaced-apart locations along lines that intersect at a point lying within the boundary of the plate and typically at the point of opening 18. Thus, as shown in FIG. 1, a first series of holes 21 is arranged at spaced-apart locations at each side of the hole 18 along a line which is generally parallel with the elongated length of the carrier plate 17. Two other series of holes 22 extend along lines which form an acute angle with the aligned arrangement of holes 21. The arrangement of the holes 21 and 22 is selected in a manner to accommodate each of the various known forms of support brackets used to carry curtain rods and the like.

Figure 3:
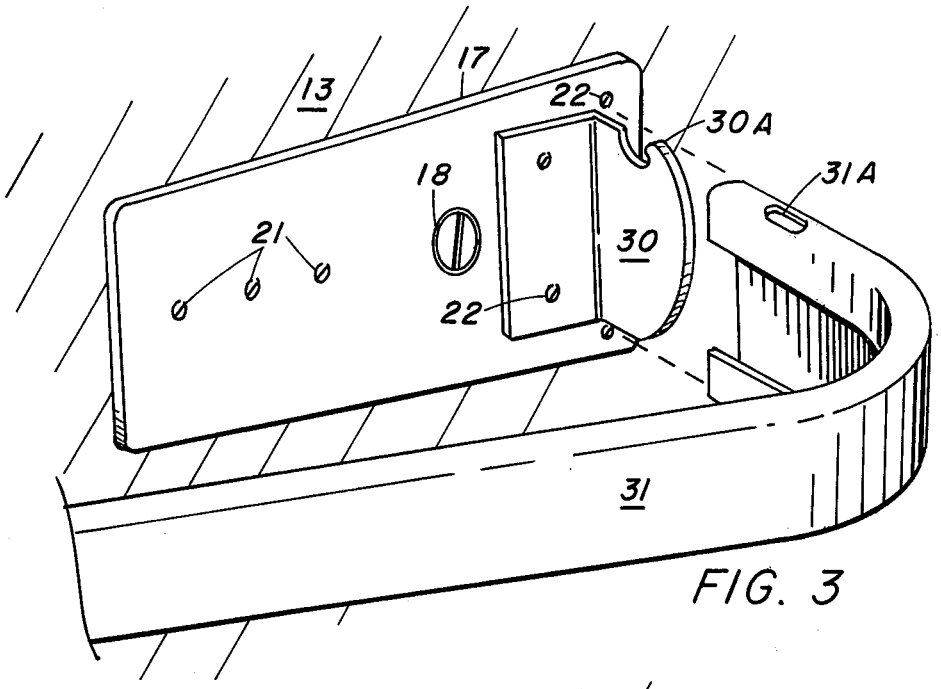
FIG. 3 is an exploded view illustrating the support apparatus of the present invention for one well-known form of curtain rod.

A first example of a typical and well-known form of curtain rod is shown in FIG. 3 wherein an adapter bracket 30 is attached by self-tapping screws passed through two spaced-apart openings in the bracket. The spacing of these openings correspond, for example, to the spacing between one hole within each series of holes 22. When the bracket 30 is attached to the carrier plate in this manner, the carrier plate 17 extends in a horizontal direction while it is, in turn, attached by the machine screw 16 for support by the base plate 10 when embedded within the wall. The adapter members 30 are used at a desired spacing for supporting the opposite ends of a curtain rod 31 which has an opening 31A in its upper edge surface adapted to receive a hooked end 30A on the adapter bracket. It is an important feature of the present invention that should a different spacing at the ends of the rod 31 between two of the adapter brackets 30 be desired, then the carrier plate is either repositioned or substituted for a different carrier plate to provide the desired spacing.

Figure 4:
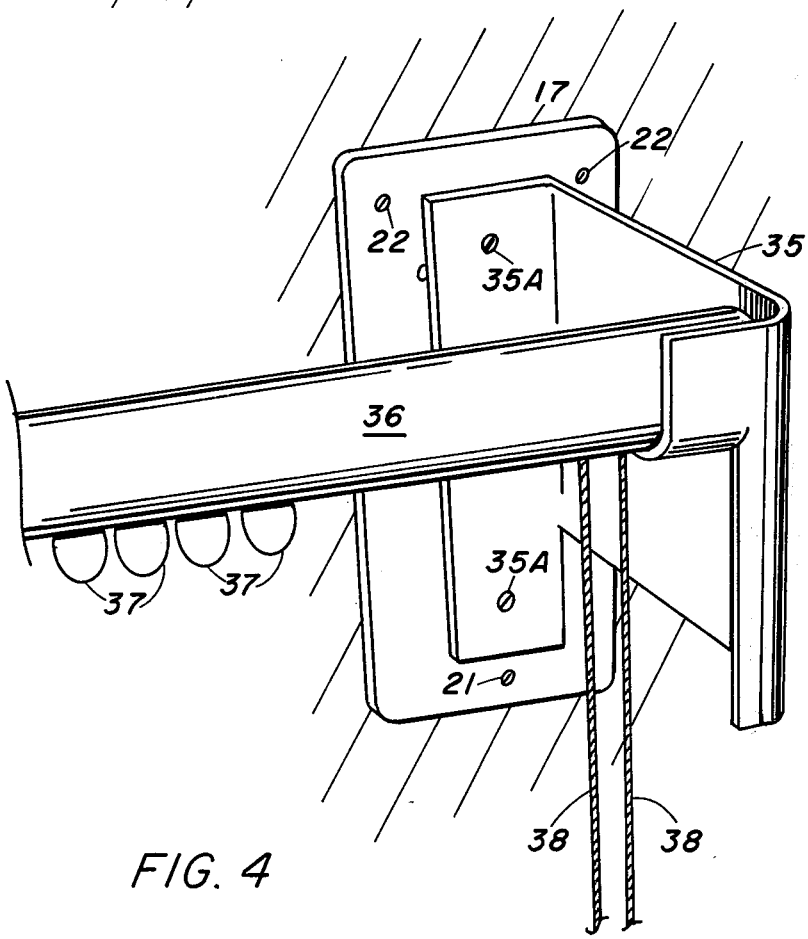
FIG. 4 is a perspective view illustrating the support apparatus of the present invention for carrying a traverse-type curtain rod.

In FIG. 4, there is illustrated adapter brackets 35 of the type which are well known in the art and used to support a traverse rod 36 which includes a plurality of eyelet members 37 to receive and support hooks that carry a drape or curtain. The eyelets 37 are moved back and forth along the length of the rod 36 by pull-cords 38. The bracket 35 is attached to the carrier plate 17 by first arranging it to extend in a generally-downward vertical direction and then selecting two of the holes 21 that are spaced apart by a distance corresponding to the spacing between the holes 35A in the adapter bracket. It will be understood, of course, that the carrier plate may be oriented in a different manner, for example, to extend in a generally horizontal direction so that the adapter 35 is supported at some desired distance from the location of the connector 15.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A support apparatus to carry a window dressing and the like, said apparatus comprising the combination of:

rod means adapted to support said window dressing, adapter brackets to releasably support the ends of said rod means while spaced outwardly from the finished face surface of a wall, two base plates embedded within said wall at two locations which are spaced apart and inwardly spaced from said finished face surface, connector means carried by each of said base plates to project outwardly from said finished face surface, two carrier plates each including means to releasably secure an adapter bracket of said rod means thereto and thereby support an end of said rod means while said carrier plates abut in a flush relation with the finished face surface of the wall, and fastening means to secure each of said two carrier plates to said connector means for transferring the load carried by said rod means onto the wall by said two base plates.

2. The support apparatus according to claim 1 wherein said connector means includes an internally-threaded tubular member projecting outwardly from said finished face surface, and wherein said fastening means include a screw having threads for mating engagement with the threads of said tubular member.

3. The support apparatus according to claim 1 wherein said base plate includes a rectangular plate having a plurality of spaced-apart openings arranged to receive fastening members for attaching said rectangular plate onto a face of a wall supporting stud within said wall.

4. The support apparatus according to claim 1 wherein said carrier plate has a trapezoidal shape with a plurality of openings lying at spaced-apart locations along lines having an intersection point within the trapezoidal shape of the carrier plate.

5. The support apparatus according to claim 1 wherein said carrier plate has a trapezoidal shape with a plurality of openings lying at spaced apart locations at opposite sides of a mounting opening in said plate for receiving said fastening means.

* * * * *